United States Patent [19]

Guillemot

[11] Patent Number: 4,747,751

[45] Date of Patent: May 31, 1988

[54] ELECTRONIC DEVICE FOR THE CONTROL OF A SUBMERSIBLE PUMP

[76] Inventor: Gilbert Guillemot, 7 rue de la Libération, 95650 Courcelles-sur-Viosne, France

[21] Appl. No.: 863,839

[22] Filed: May 16, 1986

[30] Foreign Application Priority Data

May 24, 1985 [FR] France ..... 85 07869

[51] Int. Cl.[4] ..... F04B 49/06

[52] U.S. Cl. ..... 417/36

[58] Field of Search ..... 417/36, 38; 137/392; 307/118; 416/61; 340/620

[56] References Cited

U.S. PATENT DOCUMENTS

| | | | |
|---|---|---|---|
| 2,922,854 | 6/1960 | Nielson | 417/38 X |
| 3,657,556 | 4/1972 | Foster | 307/118 |
| 4,357,131 | 11/1982 | Guillemot | 417/36 X |

FOREIGN PATENT DOCUMENTS

| | | | |
|---|---|---|---|
| 2925830 | 1/1981 | Fed. Rep. of Germany . | |
| 2460403 | 1/1981 | France . | |
| 2052061 | 1/1981 | United Kingdom . | |
| 752241 | 7/1980 | U.S.S.R. | 417/36 |

*Primary Examiner*—Leonard E. Smith
*Attorney, Agent, or Firm*—Sandler & Greenblum

[57] ABSTRACT

An electronic circuit that controls the operation of a motor whose output shaft drives an impeller for pumping a liquid includes a common grounded electrode positioned for immersion in the liquid, and a stopping electrode positioned above the common electrode. A first, latching transistor is connected to the stopping electrode which is connected to ground through the liquid when the level thereof reaches or exceeds the level of the stopping electrode. A second, power transistor operates the motor when the second transistor conducts in response to its grounding, the second transistor being connected to the starting electrode so as to be grounded when the level of liquid reaches the starting electrode. Finally, an interconnection is provided connecting the second transistor to the first transistor such that initial conduction of the second transistor effects conduction of the first transistor which maintains the second transistor in its conducting state after the liquid level drops below the level of the starting electrode.

5 Claims, 2 Drawing Sheets

ELECTRONIC DEVICE FOR THE CONTROL OF A SUBMERSIBLE PUMP

The invention relates to the control of submersible pumps employed for the raising and discharge of water or in general any liquid which is a conductor of electricity, by means of electrodes and a suitable electronic circuit.

The known means most often employed are devices having a float controlling a switch in series with the electric supply to the motor of the pump, the switch being closed for a high position of the float and opened for a relatively low position.

Other known means employ two electrodes exterior to the pump at the two levels mentioned above and a third common electrode constantly in the liquid, all associated with an electrical circuit of relays for controlling the motor.

All of these known devices have the disadvantage of being external, which increases bulk and also presents risks of damage by impact.

From the French Pat. No. 2 460 403 a solution is known with electrodes placed inside the suction strainer of a pump, but it is found to be poorly adapted to the case of a submersible pump the strainer of which is wide and of low height. According to it, at the end of pumping, air starts to pass horizontally towards the suction orifice along an unforeseeable direction because the air can enter at any point on the periphery of the strainer, the axis of the pump not always being vertical. Air can thus enter the pump without passing over the internal electrode the role of which is to cut off the motor circuit.

In fact that is where there is a fundamental problem to be solved for the employment of a submersible pump and the importance of it will be better appreciated from the explanation that follows.

Figure 1:
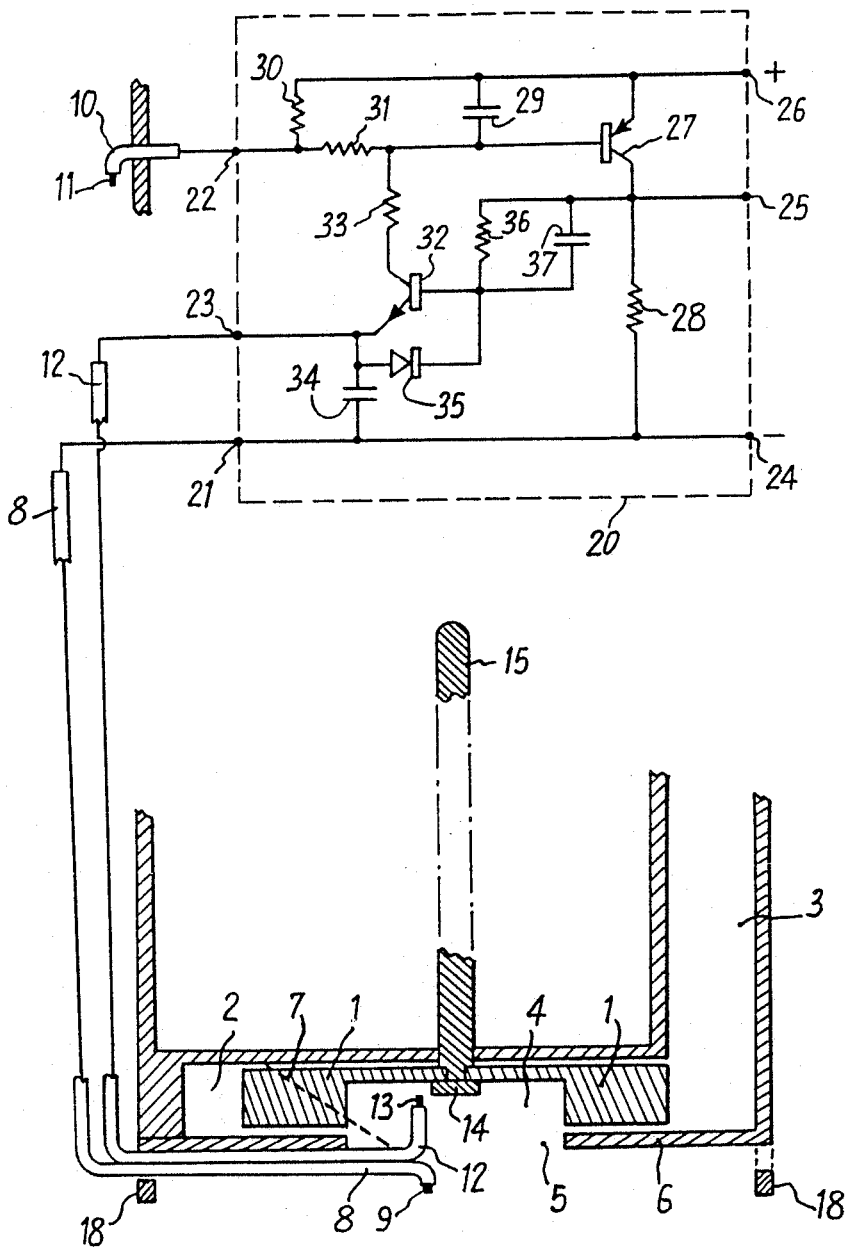
Figure 2:
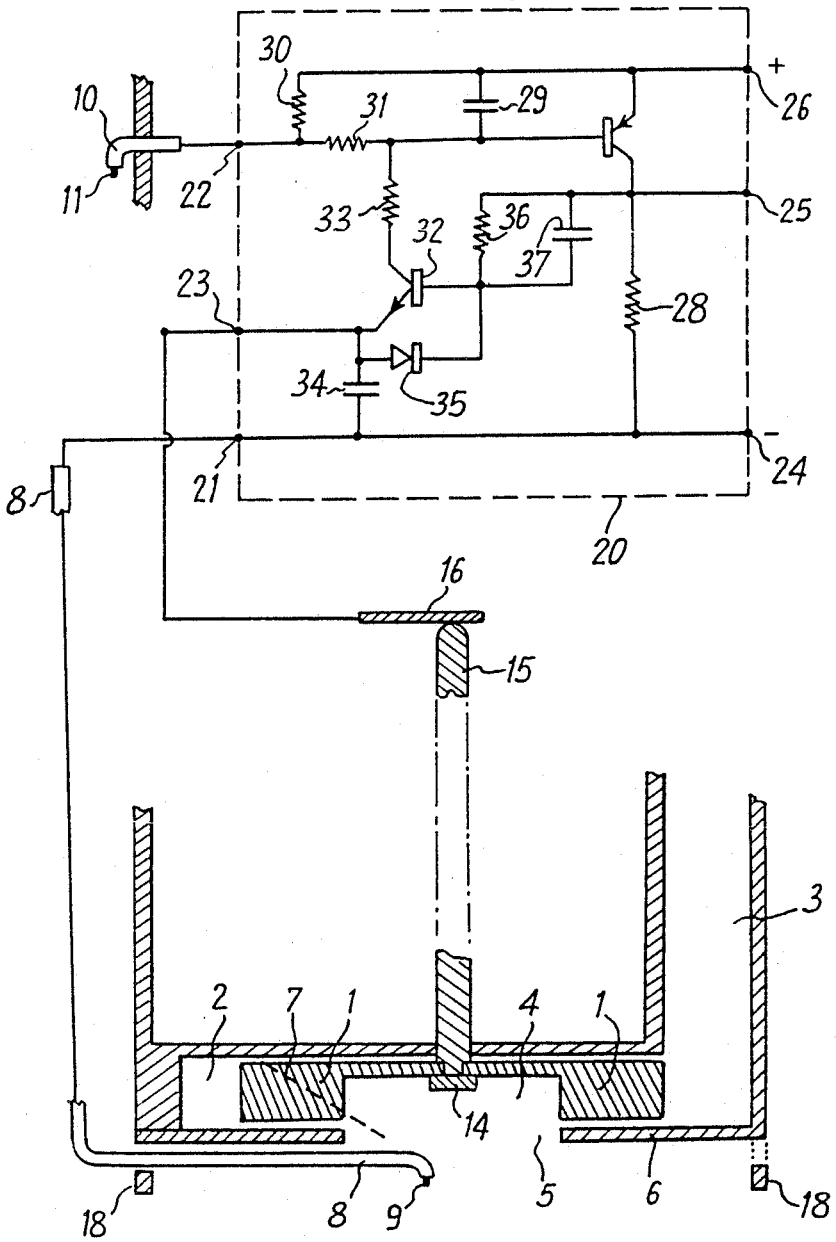

Embodiments of the invention are shown in the accompanying drawings wherein:

FIG. 1 is a schematic representation of a first embodiment of the present invention having three sets of electrodes; and FIG. 2 is a schematic representation of a second embodiment of the present invention using two sets of electrodes.

The submersible pump is a pump comprising a wheel fitted with blades 1 and carried by a shaft 15 rotatable by a motor (not shown). The wheel is situated in a chamber closed at the bottom by a lower partition 6 provided with a suction hole 5. The blades 1 are so shaped and arranged that there is a substantially annular collector 2 outwardly of their outer vertical edges and that they define by their inner vertical edges a substantially cylindrical central space 4.

At the time of normal operation of the pump there is no air in the chamber of the pump which is entirely filled with liquid. In the space 2 in the chamber swept by the blades 1 in rotation, the liquid is powerfully accelerated and projected by the centrifugal force at the periphery of the wheel into the annular collector 2 where its velocity is converted into pressure. The liquid rises in the discharge pipe 3 which communicates with the chamber, at a rate which depends upon the internal cross-sectional area of the pipe 3 and the height of the column of liquid between the collector 2 and the upper orifice of the pipe 3 for discharge to atmospheric pressure. In the central space 4 in the chamber which extends from the axis of rotation as far as the inner ends (edges) of the blades 1, the liquid is subjected to the reduced pressure created by the centrifugal scour which surrounds it, and in turn it becomes driven into the space of centrifugal acceleration and yields the place to the lower liquid which rises into the central space 4 through the hole 5 in the lower partition 6 of the chamber.

When the level of the liquid being pumped drops and reaches the level of the suction hole 5, air starts to enter, rises and accumulates at the top of the central space 4 in the chamber because of its very low density. It is this well known property of the centrifuging of fluids which enables the heavy elements collected at the periphery and the light elements near to the axis of rotation to be separated. With a very low speed of the wheel the formation of a vortex would be observed, being a surface of liquid/air separation in the form of a cone round the axis of rotation. With the normally high speed of the wheel the pattern of flow is extremely turbulent and the surface of separation is very blurred and fluctuating but it nevertheless exists. That explains how, when a sufficient volume of air becomes imprisoned in the central region of the chamber, the surface of separation 7 is such that a reduced portion of the surface of the blades 1 is stirring the liquid at their periphery. The pressure of the liquid in the collector 2 drops progressively as the active surface of the blades 1 diminishes and the volume of air increases until the time when the flow of liquid stops. The pump is unprimed and continues to revolve with the sole effect of balancing the hydrostatic pressure of the column of liquid contained in the pipe 3.

The major disadvantage of this unpriming is that the air enclosed in the central space 4 of the wheel cannot escape as long as the pump is revolving, and the liquid can rise again outside the pump without its resuming its pumping role. That is well known with this type of pump and necessitates stopping of the motor to be controlled for a rather high outside level, whereas it would be interesting to profit by the very low position of the suction hole 5 in order to extract almost completely the sheet of liquid, for example, down to at least one centrimetre instead of several centimetres when external devices are controlling the stopping of the pumping.

The device in accordance with the invention avoids this major disadvantage by the combination of a judicious choice of the location of the electrode for stopping the pump and the employment of a special electronic circuit which delivers a current of very low intensity only for the duration of the pumping, thus crediting the said electrode with a long life, that being in spite of the small dimension of its active portion necessitated by the small amount of space available for housing it; an essential special feature of the circuit is to respond in a very short time to a small increase in the contact resistance of the electrode and hence to cut off the pump as soon as possible after the first bubbles of air have been stirred with the liquid into the sensitive zone of the electrode.

Other appreciable results are obtained with the invention: there is no member for adjustment because the operation is independent of the value of the electrical conductivity of the liquids customarily employed; in addition the number of components is small. All this results in a device which is cheap, in keeping with the low cost of this type of pump, and small so that it may be placed inside the pump, which saves the external electric cabling usual when there is no automatic control.

A device in accordance with the invention will now be described, by way of example, with reference to the accompanying diagrammatic drawing. Besides the elements already described, which belong to a conventional submersible pump, those used by the invention are the following:

A set of electrodes which comprises:

a first common electrode 8, insulated or not; one end 9 of the electrode 8 is bared and lies in the lowermost portion of the cylindrical strainer 18 (the known details of which are not shown) in the vicinity of its centre; its other end is connected to the terminal 21 of an electronic cabinet 20; the wire (not shown) may have any run inside or outside the body of the pump depending upon the solution adopted for the location of the cabinet 20;

a second electrode 10 insulated from the body of the pump; one end 11 of the electrode 10 is bared and makes contact with the upper level of the liquid in order to trigger the start of pumping; its other end is connected to the terminal 22 of the cabinet 20;

a third electrode 12 insulated from the liquid with the exception of its bared end 13 which is intended for the passsage of the electric current for maintaining pumping; this electrode 12 passes through the strainer 18, enters through the suction hole 5 and rises again into the central portion 4 so that the bared end 13 is high enough and close to the end 14 of the driving shaft of the wheel, that is to say, in the first volume of air formed, the surface of separation of which from the liquid does not yet reach the blades 1 of the wheel; the other end of the electrode 12 is connected to the terminal 23 of the cabinet 20.

The electronic cabinet 20 comprises two essential interconnected portions:

(a) a first transistor 27 of p-n-p type has its emitter connected to the terminal 26 corresponding with the positive pole of a DC supply voltage; its collector is connected to a loading impedance 28 connected between the output terminals 24 and 25 across which is received the voltage intended for a power amplifier known to persons skilled in the art and not shown in the drawing; it is sufficient to understand that the motor operates when a positive voltage appears at the terminal 25 with respect to the negative pole of the supply connected to the terminal 24 which in turn is connected to the terminal 21 of the common electrode 8, and that the motor stops when the said voltage disappears because the transistor 27 is no longer conducting. A capacitor 29 of low capacity between the emitter and the base filters possible interference which might trigger the conduction of the transistor 27. A bridge consisting of a resistor 30 of low value and a bigger resistor 21 serves for the base/emitter polarization as well as for the connection of the starting electrode 10 to the terminal 22;

(b) a second transistor 32 of n-p-n type has its collector connected by a resistor 33 to the base of the transistor 27; its emitter is connected to the terminal 23 to which the stopping electrode 12 is connected; a capacitor 34 of low capacity between the terminals 21 and 23 filters possible interference; a diode 35 is connected in parallel across the emitter/base diode of the transistor 32 and in the opposite sense; the base of the transistor 32 is also connected to the collector of the transistor 27 through a resistor 36 of high value and a capacitor 37 in parallel, the capacity of the latter being distinctly higher than that of the capacitors 29 and 34.

The operation of the whole of the device in accordance with the invention is next described below.

With the pump at rest, the electrodes 8 and 12 are drowned in the liquid but the electrode 10 is in the air. The transistors 27 and 32 are blocked, there is no voltage across the terminals 23 and 25 and the electrode 10 is at the positive voltage of the supply.

When the liquid rises to the level of the electrode 10 the contact obtained triggers the conduction of the transistor 27 and the pump starts, while a current is established in the base of the transistor 32 which in turn becomes conductive and locks the conduction of the transistor 27 well before the electrode 10 loses contact with the liquid as its level drops. The operation of the pump is maintained by the very small emitter current of the transistor 32 which passes between the electrodes 8 and 12 through the liquid in the portion 4 of the wheel.

During operation a certain positive voltage appears at the emitter of the transistor 32, which is variable depending upon the conductivity of the liquid, and the voltage of the base follows that of the emitter with the result that the capacitor 37 is charged at a voltage which reflects the value of this conductivity.

As soon as the pump starts to suck air and the apparent resistance between the electrodes tends to increase, the capacitor 37 imposes its voltage whereas that of the emitter rises; the transistor 32 is blocked, bringing about blocking of the transistor 27 and stopping of the pump. At this moment the residue of liquid in the pump is flowing, which frees the small amount of air trapped; the end 13 of the electrode 12 may again be in contact with the liquid for another cycle triggered by the rising of the level up to the electrode 10. Thus it may be seen that the cutting off of the pump occurs before the quantity of air admitted causes the hydrodynamic pressure created by the blades of the wheel to drop.

It may be observed that the choice of the values of the resistors 30 and 31 is such that the current which passes in the electrode 10 during the short moment when it is acting is fairly heavy, of the order of several milliamperes, compared to that of less then 0.1 mA in the maintaining electrode; but the interest of this connection is to prevent a prolongation of action of the electrode 10 in air by leakage currents at the wet surface of the pump, for example, in the case of a highly conductive liquid. This electrode may also have a certain length in order to locate the end of it at the level chosen for the start of pumping.

Other variant embodiments are possible whilst remaining within the scope of the accompanying claims.

The common electrode 8 may be omitted when the pump includes a metallic structure in contact with the liquid; in this case it is sufficient to connect the terminal 21 to this structure.

Another interesting embodiment omits the electrode 12 and employs the metallic end 14 of the driving shaft of the wheel when the latter is of insulating matter. In this case the electrically conductive driving shaft must be insulated from the structure of the pump and its top end 15 revolves against a contact 16 connected to terminal 23 of the cabinet 20 so that the end 14 at the centre of the wheel plays the same role as the end 13 of the electrode 12.

Furthermore as far as the electronic circuit is concerned, it is obvious to a person skilled in the art that one may employ an equivalent circuit by reversing all of the polarities; that is to say, employ a transistor 27 of n-p-n type and a transistor 32 of p-n-p type, reverse the polarities of the supply (terminal 24 positive and 26 negative) and reverse the diode 35. The currents flow in the opposite direction in the electrodes but the operation of the whole is unchanged. One interesting special feature of this configuration is that the active end 13 of the stopping electrode 12 (or the end 14 of the shaft of the wheel) plays the part of a cathode and does not undergo any electrolytic dissolution, which does away with the problem of its length of life. Only the electrode 8 plays the part of anode but its very weak anodic dissolution is without disadvantage because one is not limited by the extent of its active surface.

By way of example, in a device produced in accordance with the invention, the DC voltage source had a voltage of 12 volts obtained by transformation, rectification and filtration from the 220-volts main which otherwise feeds the motor of the pump. The load impedance 28 was the coil of a relay controlling the motor. The current in the electrodes 8 and 12 during pumping was limited to about 80 microamperes for an apparent resistance of the liquid variable from about 1,000 to 50,000 ohms depending upon the nature of the liquid. The reaction time for cut-off of the circuit was of the order of a fraction of a millisecond for an increase in the apparent resistance of about 20%. The whole of this operation was thus very satisfactory.

It is important to note that these good performances obtained with a circuit including so few components lies in the choice of the latter. That is, two functions must be ensured:

- an amplification function of a weak analogue signal representing the variations in apparent resistance between the electrodes;
- a switching function of the terminals 22 and 23 (which a self-maintained relay would effect), which normally necessitates two other transistors mounted in flip-flop.

The reduction to an assembly of two transistors only for the two functions is obtained by choosing the polarization of the transistor 27 to be such that it conducts at the limit of saturation for a collector current defined by the impedance 28 and the supply voltage, which determines the values of the resistances 30 and 31 which must divert a portion of the control current delivered by the transistor 32; the collector current of the latter transistor depends little upon the nature of the liquid because the resistance 33 is about ten times greater than the apparent resistance between the electrodes 8 and 12. The very rapid and irreversible collapse of the conduction of the transistor 27 is ensured by the transmission of a drop in its collector voltage through the capacitor 37 to the base of the transistor 32, rapidly blocking the latter and then in turn the transistor 27. Thus the two transistors work simultaneously in amplification and switching duties. Hence an efficient circuit is available, the cost of which is low with respect to more conventional circuits.

I claim:

1. A device for the control of a submersible pump, the pump having a wheel fitted with blades and carried by a shaft rotatable by a motor, the wheel being situated in a chamber closed at the bottom by a lower partition provided with a suction hole, the blades being shaped and arranged to define by their inner vertical edges a cylindrical central space, the device comprising a first electrode, which is a constantly submersible common electrode, a second electrode, which is a high-level electrode for starting the motor, and a third electrode which is a low level electrode for stopping the motor, wherein the third electrode is insulated over nearly the whole of its length, passes under the lower partition and enters through the suction hole into the cylindrical central spacing, the third electrode having a first end which is bared and is situated in the vicinity of the center of the central space where the air that has entered the chamber can accumulate, and a second end connected to the one terminal of an electronic circuit comprising a transistor having an emitter connected to said one terminal and a collector and a base connected to an active circuit for activating said motor during a pumping phase.

2. A device according to claim 1, wherein the wheel is of electrically insulating material and the shaft, which is of metal, replaces the third electrode the lower end of the shaft being in contact with the liquid in the central space its upper end rotating in contact with a fixed contact connected to the circuit as would be the electrode.

3. A device according to claim 1 or 2, wherein the electronic circuit comprises:

- a first transistor the base of which receives the starting signal from the second electrode through a bridge of two resistors connected between emitter and base, and the collector of which feeds a loading impedance at the terminals of which the voltage is taken off for control of the pump motor, the value of the resistor being chosen so that said transistor conducts at the saturation limit of its collector current,
- a second transistor, the type of which is the opposite of that chosen for the first transistor and the collector of which is connected by a resistor to the base of the first transistor; its emitter is connected to the third electrode; its base is connected through a resistor and a capacitor in parallel, to the collector of the first transistor; a diode connects emitter and base of the second transistor in the sense which is the opposite of the emitter/base diode;
- a DC supply source connected between the emitter of the first transistor and the end of the load opposite from that connected to the collector, the polarities being chosen as a function of the type of this transistor; the end of the load not connected to the collector being connected to the first electrode.

4. An electronic circuit for controlling the operation of a motor whose output shaft drives an impeller for pumping a liquid, said circuit comprising:

(a) a common electrode positioned for immersion in the liquid and connected to a reference voltage;

(b) a stopping electrode positioned above the common electrode;

(c) a starting electrode positioned above the stopping electrode;

(d) a first transistor connected to said stopping electrode which is connectable to said reference voltage through said liquid when the level thereof exceeds the level of said stopping electrode;

(e) a second transistor for operating said motor when the second transistor conducts in response to the application thereto of said reference voltage, said second transistor being connected to said starting electrode whereby said reference voltage is applied to said second transistor when the level of liquid reaches the level of said starting electrode; and (f) interconnection means connecting said second transistor to said first transistor such that initial conduction of said second transistor effects conduction of said first transistor which maintains said second transistor in a conducting state after the liquid level drops below the level of said starting electrode.

5. An electronic circuit according to claim 4 including a capacitor charged to a predetermined level while said first transistor conducts, and which is discharged when the liquid level drops below the stopping electrode.

* * * * *

UNITED STATES PATENT AND TRADEMARK OFFICE

CERTIFICATE OF CORRECTION

PATENT NO. : 4,747,751

DATED : May 31, 1988

INVENTOR(S) : Gilbert GUILLEMOT

It is certified that error appears in the above-identified patent and that said Letters Patent is hereby corrected as shown below:

Column 1, line 7, insert ---,--- after "or".
Column 1, line 7, insert ---,--- after "general".
Column 1, line 33, insert ---,--- after "electrode".
Column 2, line 65, insert ---,--- after "addition".
Column 3, line 33, delete "of which".
Column 4, line 54, change "whilst" to ---while---.
Column 4, line 63, insert ---,--- after "case".
Column 4, line 65, change "revolves" to ---revolve---.
Column 5, line 1, insert ---,--- after "Furthermore".
Column 6, line 5, insert ---,--- after "electrode" (second occurrence).

Signed and Sealed this

Twenty-fifth Day of April, 1989

*Attest:*

DONALD J. QUIGG

*Attesting Officer*

*Commissioner of Patents and Trademarks*